US007405637B1

(12) United States Patent
Mehta et al.

(10) Patent No.: US 7,405,637 B1
(45) Date of Patent: Jul. 29, 2008

(54) MINIATURE TUNABLE FILTER HAVING AN ELECTROSTATICALLY ADJUSTABLE MEMBRANE

(75) Inventors: Sarabjit Mehta, Calabasas, CA (US); Peter Petre, Oak Park, CA (US)

(73) Assignee: HRL Laboratories, LLC, Malibu, CA (US)

( * ) Notice: Subject to any disclaimer, the term of this patent is extended or adjusted under 35 U.S.C. 154(b) by 70 days.

(21) Appl. No.: 11/166,032

(22) Filed: Jun. 23, 2005

Related U.S. Application Data

(60) Provisional application No. 60/584,062, filed on Jun. 29, 2004.

(51) Int. Cl.
*H01P 1/205* (2006.01)

(52) U.S. Cl. ..... 333/207; 333/235

(58) Field of Classification Search ..... 333/203, 333/205, 207, 235
See application file for complete search history.

(56) References Cited

U.S. PATENT DOCUMENTS

| | | | | |
|---|---|---|---|---|
| 4,450,421 | A * | 5/1984 | Meguro et al. | 333/202 |
| 4,757,284 | A * | 7/1988 | Ueno | 333/203 |
| 5,406,233 | A * | 4/1995 | Shih et al. | 333/161 |
| 5,461,003 | A | 10/1995 | Havemann et al. | 438/187 |
| 5,510,645 | A | 4/1996 | Fitch et al. | 257/522 |
| 5,550,519 | A * | 8/1996 | Korpela | 333/207 |
| 5,738,799 | A | 4/1998 | Hawkins et al. | 216/27 |
| 5,853,601 | A | 12/1998 | Krishaswamy et al. | 216/2 |
| 5,888,942 | A * | 3/1999 | Matthaei | 505/210 |
| 6,251,798 | B1 | 6/2001 | Soo et al. | 438/758 |
| 6,287,979 | B1 | 9/2001 | Zhou et al. | 438/723 |
| 6,516,208 | B1 * | 2/2003 | Eden | 505/210 |
| 6,791,430 | B2 * | 9/2004 | Borzenets et al. | 333/17.1 |
| 2002/0020053 | A1 | 2/2002 | Fonash et al. | 29/623.1 |
| 2004/0197526 | A1 | 10/2004 | Mehta | 428/156 |

OTHER PUBLICATIONS

Barker, N.S., "Distributed MEMS True-Time Delay Phase Shifters and Wide-Band Switches," *IEEE Transactions on Microwave Theory and Techniques*, vol. 46, No. 11, pp. 1881-1890 (Nov. 1998).

* cited by examiner

*Primary Examiner*—Benny Lee
(74) *Attorney, Agent, or Firm*—Ladas & Parry

(57) ABSTRACT

A miniature tunable filter comprising filter poles disposed with a filter substrate. A moveable electrically conductive membrane is disposed above each filter pole and is spaced from the filter pole by an air or vacuum gap. The gap spacing is changed by deflecting the membrane with an electrostatic voltage. The change in gap spacing varies the capacitive loading at the pole, thus providing tuning of the filter. The electrically conductive membrane is preferably manufactured on a separate substrate that is bonded to the filter body containing the filter substrate.

26 Claims, 1 Drawing Sheet

MINIATURE TUNABLE FILTER HAVING AN ELECTROSTATICALLY ADJUSTABLE MEMBRANE

CROSS REFERENCE TO RELATED APPLICATIONS

This application claims the benefit of U.S. provisional Patent Application Ser. No. 60/584,062, filed Jun. 29, 2004 for a "Miniature Tunable Filter" by Sarabjit Mehta and Peter Petre, the disclosure of which is incorporated herein by reference.

BACKGROUND

1. Field

This disclosure relates generally to filters for electromagnetic signals and, more specifically, to tunable filters for use with radio frequency, microwave frequency, or millimeter wave frequency signals.

2. Description of Related Art

Filtering devices for filtering radio frequency, microwave frequency, and millimeter wave frequency signals are well known in the art. Stripline or planar microstrip filters are examples of filters used in microwave systems. These filters have the advantage of being relatively small, but they also have a relatively high insertion loss and are typically not easily tunable.

Combline filters or Capacitively Loaded Interdigital Filters (CLIF) are also known in the art. These filters usually have a lower insertion loss than the stripline or planar microstrip filters, but combline filters or CLIFs are typically larger in size than the stripline or planar microstrip filters. Combline filters or CLIFs may not be tunable. Those combline filters or CLIFs that are tunable typically exhibit a response time on the order of milliseconds, due to the relatively large size of such filters. Also, the relatively large size of such filters typically requires fabrication using machine shop processing techniques, rather than wafer scale processing that is typically used for smaller electronic components.

SUMMARY

Embodiments of the present invention provide a method and apparatus for filtering electromagnetic signals. An embodiment of the present invention comprises a miniature tunable filter having a filter body made of a low loss dielectric material such as silicon or ceramic. Filter poles are disposed within the filter body and the filter poles are tuned by deflecting electrically conductive membranes that are suspended over the filter poles and that are separated from the filter poles by air or vacuum filled gaps. The disposition of flexible electrically conductive membranes over the poles allows the capacitive loading at the poles to be varied, which allows the miniature filter to be tuned.

According to a first aspect, a filter is disclosed, comprising: a filter substrate; and one or more filter pole structures, each filter pole structure comprising: a filter pole disposed within the filter substrate; a gap disposed above the filter pole; an electrically conductive membrane disposed above the filter pole and spaced from the filter pole by the gap, the gap having a gap distance; and a tuning element disposed adjacent to the electrically conductive membrane, wherein the tuning element applies an electrostatic voltage to the electrically conductive membrane and the electrically conductive membrane changes the gap distance according to the applied electrostatic voltage.

According to a second aspect, a method of filtering is disclosed, comprising disposing one or more filter poles in a filter substrate; varying the capacitive loading of at least one filter pole of the one or more filter poles.

The tuning gaps may initially be very small, on the order of 8 μm, and the tuning process may vary to gaps by up to 10 μm or greater. The high sensitivity of the tuning process to the gap size allows the use of relatively small flexible membranes, for example, 1 mm×1 mm. The small size of the membranes also allows for a relatively fast response time, on the order of 1 to 10 μs or better.

A transformer structure may be used at the input and output of the filter, which may provide for optimization of the filter response.

Embodiments of the miniature filter according to the present invention are preferably manufactured using standard clean room processing and thin film deposition techniques. Such techniques may allow for the fabrication of large numbers of the miniature filters using wafer level processing.

BRIEF DESCRIPTION OF THE DRAWINGS

The features and advantages of the present disclosure will become better understood with regard to the following description, appended claims, and accompanying drawings.

DETAILED DESCRIPTION

Figure 1:
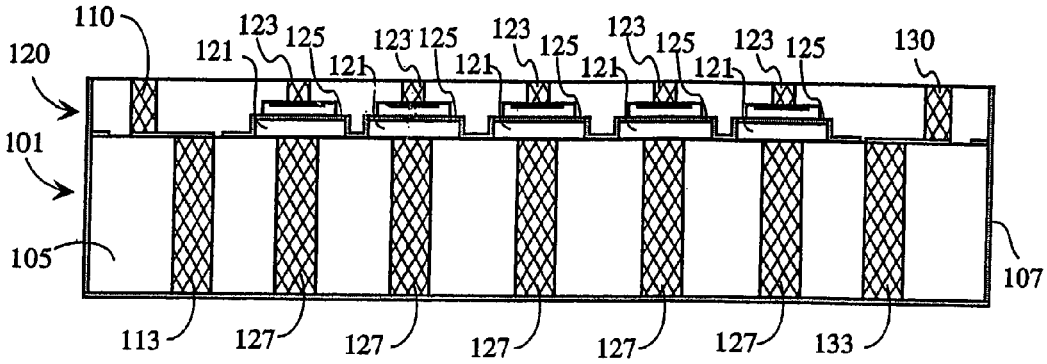
FIG. 1 shows a side view of a miniature tunable filter according to an embodiment of the present invention.

The present disclosure will now be described more fully hereinafter with reference to the accompanying drawings, in which preferred embodiments of the invention are shown. This disclosure may be embodied in many different forms and should not be construed as limited to the embodiments set forth herein. Further, the dimensions of certain elements shown in the accompanying drawings may be exaggerated to more clearly show details. The present disclosure should not be construed as being limited to the dimensional relations shown in the drawings, nor should the individual elements shown in the drawings be construed to be limited to the dimensions shown.

A miniature tunable filter according to an embodiment of the present invention is depicted in FIG. 1. The tunable filter comprises a filter body 101 that is preferably made from a high $\epsilon_r$ substrate 105, such as low loss silicon or ceramic. Use of such substrates allows the overall size of the filter to be kept small. Filter poles 127 are disposed within the filter body 101 and are preferably surrounded by the substrate material. The filter poles 127 are made of an electrically conductive material, preferably gold or silver, although other conductive materials may be used. Sidewalls 107 are preferably disposed on at least some of the sides of the filter body 101. The sidewalls also preferably comprise an electrically conductive material.

The upper portion of the filter comprises flexible metallized membranes 125 that are suspended over the filter poles 127 and that are separated from the filter poles 127 by air or vacuum filled gaps 121. The membranes 125 and associated structures are preferably fabricated on a separate substrate 120, shown in FIGS. 1 and 2, utilizing a process described in U.S. Pat. No. 7,128,843, filed on Feb. 24, 2004 and titled "Process for Fabricating Monolithic Membrane Substrate Structures with Well-Controlled Air Gaps," incorporated herein by reference. The process described in U.S. Pat. No.

7,128,843 provides a monolithic membrane-substrate structure. According to an embodiment of the present invention, this monolithic substrate can be metallized and bonded to the top of the filter body 101 to form the air or vacuum filled gaps 121. Tuning elements 123 receive voltages that are preferably on the order of 0-400V or 200-400V. Application of these voltages at the tuning elements 123 cause the flexible membranes 125 to deflect due to the electrostatic effect. The deflection of the flexible membranes 125 change the capacitive loading at the filter poles 127, thereby tuning the filter.

Therefore, the structure or filter disclosed in FIG. 1 is hybrid one, because it is in part air- or vacuum-filled (gaps 121) and in part dielectric-filled (silicon or ceramic substrate 105).

Figure 2:
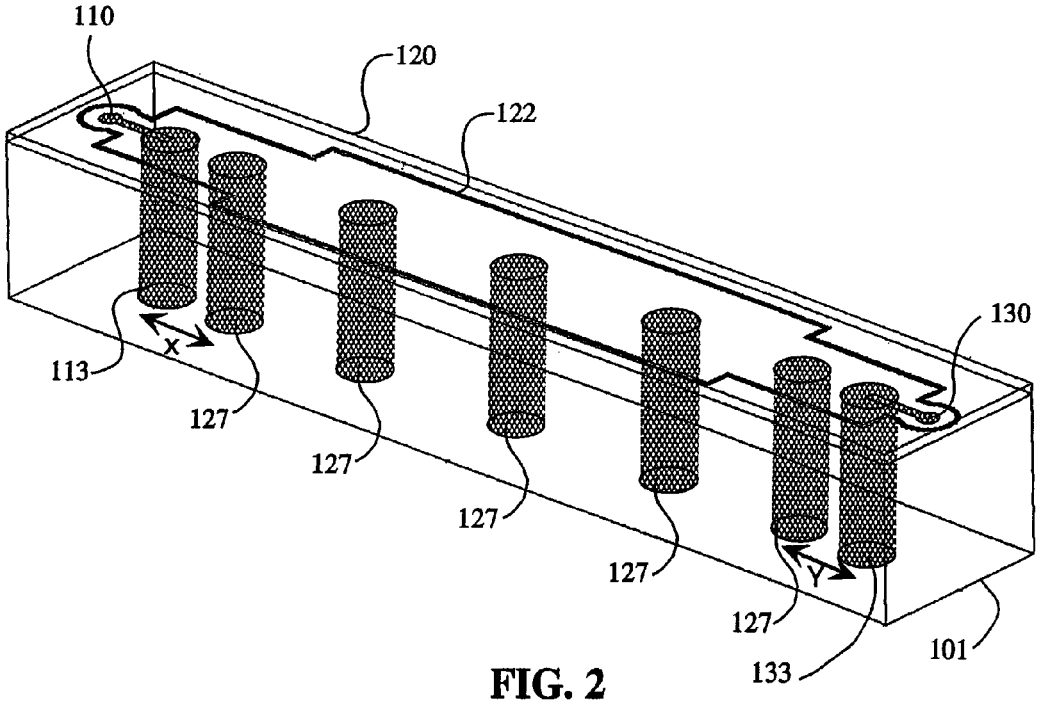
FIG. 2 shows a perspective view of the miniature tunable filter shown in FIG. 1

FIG. 2 shows a perspective view of the tunable filter depicted in FIG. 1. FIG. 2 shows the general outline 122 of the portions of the separate substrate on which the flexible metallized membranes 125 and the tuning element 123, shown in FIG. 1, have been fabricated. In FIGS. 1 and 2, an input electrical signal may be coupled to an input contact line 110 and the signal output from the filter will be present at an output contact line 130. As noted above, filters according to embodiments of the present invention may be quite small, on the order of 2 mm×2 mm×10 mm, or smaller.

In a preferred embodiment according to the present invention, transformer poles 113, 133, shown in FIGS. 1 and 2, are used to couple electric signals into and out of the filter. Preferably, an input transformer pole 113 is electrically coupled to the input contact line 110 and an output transformer pole 133 is coupled to the output contact line 130. The input transformer pole 113 is spaced apart from the nearest filter pole 127 by a distance "X" and the output transformer pole 133 is spaced apart from the nearest filter pole 127 by a distance "Y" as shown in FIG. 2. By varying either the distance "X" or the distance "Y" or both, the Q of the filter and, hence, the overall response of the filter, can be optimized to the desired specifications. Since the input contact line 110 and the output contact line 130 are planar with the top of the filter body 101, standard clean room processing and thin film deposition techniques may be used to provide the coupling to the input and output transformer poles 113, 133. An alternative approach to provide the desired Q would be to tap the input and/or output lines to the transformer or filter poles at some depth within the filter body.

Therefore, the device and method according to the present disclosure are compatible with planar processing and, differently from conventional methods, allow large scale (wafer level) fabrication.

Further, the input transformer pole 113 and the output transformer pole 133 allow the Q of the tunable device to be controlled by variation of the distance between the transformer poles and the nearest filter poles, such that subsequent fabrication steps are compatible with planar processing.

The embodiment of the present invention depicted in FIGS. 1 and 2 show six filter poles. Those skilled in the art will understand that other embodiments according to the present invention may be implemented with more than or fewer than six filter poles. Those skilled in the art will also understand that while FIGS. 1 and 2 depict a filter pole layout similar to a combline design, other embodiments according to the present invention may use a filter pole layout similar to a CLIF design.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . ."

What is claimed is:

1. A filter comprising:

a filter substrate; and one or more filter pole structures, each filter pole structure comprising:

a filter pole disposed within the filter substrate;

a gap disposed above the filter pole;

a electrically conductive membrane disposed above the filter pole and spaced from the filter pole by the gap, the gap having a gap distance; and a tuning element disposed adjacent to the electrically conductive membrane, wherein the tuning element applies an electrostatic voltage to the electrically conductive membrane and the electrically conductive membrane changes the gap distance according to the applied electrostatic voltage.

2. The filter according to claim 1, wherein the filter substrate comprises low loss silicon or ceramic.

3. The filter according to claim 1, wherein the respective electrically conductive membrane and the corresponding tuning element are disposed in a second substrate that is bonded to the filter substrate.

4. The filter according to claim 1, wherein the filter further comprises:

an input transformer pole adapted to receive an input electrical signal, the input transformer pole disposed in the filter substrate and adjacent to a first one of the filter pole structures, the input transformer pole spaced apart from the first filter pole structure by an input transformer pole distance; and/or an output transformer pole adapted to output an output electrical signal, the output transformer pole disposed in the filter substrate and adjacent to the first filter pole structure or a second one of the filter pole structures, the output transformer pole spaced apart from the first or second filter pole structure by an output transformer pole distance.

5. The filter according to claim 4, wherein the input transformer pole distance and/or the output transformer pole distance provide a desired Q for the filter.

6. The filter according to claim 4, wherein the input transformer pole and/or the output transformer pole comprise gold, silver or other conductive material.

7. The filter according to claim 1, wherein the one or more filter structures comprises gold, silver or other conductive material.

8. The filter according to claim 1, wherein the respective electrically conductive membrane comprises a flexible metallized membrane.

9. The filter according to claim 1, wherein the respective electrostatic voltage comprises a voltage in the range from 200V to 400V.

10. The filter according to claim 1, wherein the gap comprises air or vacuum.

11. The filter according to claim 1, wherein the filter is partly air- or vacuum-filled and partly dielectric-filled.

12. The filter according to claim 1, wherein the number of gaps corresponds to the number of filter poles disposed within the filter substrate.

13. The filter according to claim 1, wherein each gap is disposed entirely above the corresponding filter pole.

14. The filter according to claim 1, wherein the number of electrically conductive membranes corresponds to the number of filter poles disposed within the filter substrate.

15. The filter according to claim 1, wherein the respective electrically conductive membrane is disposed entirely above the corresponding filter pole.

16. A method comprising:

disposing one or more filter poles through a filter substrate;

disposing a respective electrically conductive membrane above each corresponding filter pole, wherein each electrically conductive membrane is spaced from the corresponding filter pole by a gap distance; and varying the capacitive loading of at least one filter pole of the one or more filter poles by applying an electrostatic voltage to the respective electrically conductive membrane to vary respective gap distance between the respective electrically conductive membrane and the at least one filter pole.

17. The filter according to claim 16, wherein the number of electrically conductive membranes corresponds to the number of filter poles.

18. The method according to claim 16, wherein the respective gap distance defines an air gap or a vacuum gap.

19. The method according to claim 16, wherein the one or more filter poles comprise gold, silver or other conductive material.

20. The method according to claim 16, wherein the respective electrically conductive membrane comprises a flexible metallized membrane.

21. The method according to claim 16, wherein applying an electrostatic voltage comprises applying a voltage in a range from 200V to 400V.

22. The method according to claim 16, further comprising one or both of:

coupling an electrical signal into a first one of the filter poles with an input transformer pole disposed in the filter substrate;

coupling an electrical signal out of the first filter pole or a second one of the filter poles with an output transformer pole disposed in the filter substrate.

23. The method according to claim 22, further comprising one or both of:

selecting a distance between the input transformer pole and the first filter pole;

selecting a distance between the output transformer pole and the first filter pole or the second filter pole.

24. The filter according to claim 16, wherein side walls of the one or more filter poles extending along a longitudinal axis of the each filter pole are in contact with the filter substrate.

25. The method according to claim 16, wherein a tuning element applies the electrostatic voltage to the corresponding electrically conductive membrane.

26. The method according to claim 16, wherein the capacitive loading of the at least one filter pole can be varied independently of the capacitive loading of another filter pole.

* * * * *

UNITED STATES PATENT AND TRADEMARK OFFICE

CERTIFICATE OF CORRECTION

PATENT NO. : 7,405,637 B1
APPLICATION NO. : 11/166032
DATED : July 29, 2008
INVENTOR(S) : Sarabjit Mehta et al.

It is certified that error appears in the above-identified patent and that said Letters Patent is hereby corrected as shown below:

Column 1, line 13, please insert the following paragraph:

STATEMENT REGARDING FEDERALLY SPONSORED RESEARCH OR DEVELOPMENT

The present invention was made with support from the United States Government under contract no. N00014-02C-0478 awarded by the Department of the Navy, Office of Naval Research. The U.S. Government has certain rights in the invention.

Signed and Sealed this

Ninth Day of September, 2008

JON W. DUDAS
*Director of the United States Patent and Trademark Office*